US007090567B2

(12) United States Patent
Fermé

(10) Patent No.: US 7,090,567 B2
(45) Date of Patent: Aug. 15, 2006

(54) METHOD AND AN ELEMENT FOR SURFACE POLISHING

(75) Inventor: Jean-Jacques Fermé, Velaux (FR)

(73) Assignee: Societe Europeenne de Systemes Optiques, Aix en Provence Cedex (FR)

( * ) Notice: Subject to any disclaimer, the term of this patent is extended or adjusted under 35 U.S.C. 154(b) by 0 days.

(21) Appl. No.: 11/122,359

(22) Filed: May 5, 2005

(65) Prior Publication Data

US 2005/0250426 A1 Nov. 10, 2005

(30) Foreign Application Priority Data

May 7, 2004 (FR) ..... 04 04946

(51) Int. Cl.
*B24B 1/00* (2006.01)

(52) U.S. Cl. ..... 451/63; 451/41

(58) Field of Classification Search ..... 451/41, 451/63, 285–289, 296; 438/690–692
See application file for complete search history.

(56) References Cited

U.S. PATENT DOCUMENTS 2,998,680 A 9/1961 Lipkins
6,168,508 B1 * 1/2001 Nagahara et al. ..... 451/527
6,251,785 B1 * 6/2001 Wright ..... 438/692
6,290,578 B1 9/2001 Bowman et al.
6,857,941 B1 * 2/2005 Emami et al. ..... 451/41
2001/0000497 A1 * 4/2001 Epshteyn et al. ..... 438/691

FOREIGN PATENT DOCUMENTS

WO WO 01/27350 A 4/2001

* cited by examiner

*Primary Examiner*—Dung Van Nguyen
(74) *Attorney, Agent, or Firm*—Alston & Bird LLP

(57) ABSTRACT

A surface polishing method in which a workpiece having at least one surface for polishing is set into rotation and has said surface pressed against a polishing element that is driven with motion in rotation or in translation, wherein said surface of the workpiece presents points that are situated outside a circumference of center coinciding with the center of rotation of the workpiece and traveling, during one revolution of said workpiece, along a path comprising first and second portions, with the rate of polishing over said second portion being smaller than over said first portion, in such a manner as to compensate for an over-polishing effect that occurs on the edge of said workpiece over said first portion of the path.

11 Claims, 5 Drawing Sheets

METHOD AND AN ELEMENT FOR SURFACE POLISHING

The invention relates to improving a method of surface polishing using the chemical mechanical polishing (CMP) technique. More particularly, but in non-limiting manner, the invention applies to CMP polishing of plane surfaces of large dimensions (greater than or equal to 150 millimeters (mm) by 150 mm), made of silica, ceramic, vitreous material, silicon, etc., that needs to present planeness of the order of 100 nanometers (nm) or less, such as the surfaces of lithographic masks used in fabricating electronic chips.

BACKGROUND OF THE INVENTION

Chemical mechanical polishing is a technique that is well known, used both in optics and in microelectronics. Its principle consists in pressing the surface to be polished with force against a polishing element that is in motion relative thereto and that is soaked in a suspension of abrasive particles known as slurry. The polishing element is typically a pad of polyurethane foam or a felt of textile fibers bonded together by a polyurethane matrix. By way of example, the slurry may be colloidal silica, a suspension of cerium oxide, etc.

More detailed information on this technique is to be found in the PhD thesis of Jiun-Yu Lai "Mechanics, mechanisms, and modeling of the chemical mechanical polishing process", Massachusetts Institute of Technology, Feb. 2001.

In its most common form (rotary CMP) the polishing element is circular in shape and performs rotary motion; a "workpiece-carrier" keeps the workpiece that is to be machined rotating with one of its surfaces in contact with the polishing element. There are also exist linear CMP machines in which the polishing element is carried by a looped belt driven with linear motion, like a conveyor belt. Only rotary CMP is considered in detail below, but the invention is equally applicable to linear CMP.

When it is necessary to polish both faces of a workpiece, such as a lithographic mask, it is advantageous to use a dual-face CMP method in which the workpiece is sandwiched between two polishing elements that apply a compression force. The workpiece-carrier must be designed to allow both faces to make contact simultaneously with the polishing elements.

Experience shows that the edge of the workpiece presents over-polishing that can be very considerable. This is due to the polishing element being flattened, giving rise to extra pressure in the vicinity of said edge, and also to abrasive particles accumulating. This results in a non-planar zone in the polished surface that can extend over a significant fraction of the diameter of the workpiece, for example over about 15 mm for a workpiece that is 150 mm in diameter (10%). The effect is even more marked for non-circular workpieces presenting sharp angles. A more thorough discussion about the effect of over-polishing is to be found in the article by Jianfeng Luo "Wafer-scale CMP modeling of within wafer non-uniformity", Laboratory for Manufacturing Automation, University of California, Berkeley.

A first solution to this problem consists in providing workpieces with a peripheral zone that is to be cut off after polishing. Apart from the fact that that technique is very expensive and involves wasting material, the cutting operation itself induces mechanical defects that degrade the surface state of the workpiece. It is therefore not adapted to lithographic masks, and more generally to ultraviolet optics, since the maximum size of defects that can be accepted is no greater than a few tens of nanometers.

A second solution, e.g. as described in the above-mentioned article by Jianfeng Luo, consists in surrounding the workpiece with a guard ring, and it is the guard ring that is subjected to over-polishing instead of the workpiece. That technique is also expensive since the guard ring needs to be produced with tolerances that are very strict and it needs to be replaced after a small number of uses. This drawback is particularly marked with dual-face polishing since the ring must have exactly the same thickness as the workpiece and a single use can thin it to such an extent as to make its replacement necessary.

OBJECTS AND SUMMARY OF THE INVENTION

An object of the present invention is to provide a polishing method for use on one or two faces that avoids the effect of over-polishing the edges, while not presenting certain drawbacks of methods known in the prior art.

Another object of the present invention is to provide a polishing element suitable for implementing such a method.

At least one of these objects is achieved by a method of polishing a surface in which at least one workpiece having at least one surface for polishing is set into rotation and has said surface pressed against a polishing element that is driven with rotary or linear motion, wherein, preferably throughout the entire duration of the polishing process, points of said surface of the workpiece that are situated outside a circumference of given radius of center coinciding with the center of rotation of the workpiece travel, during rotation of said workpiece, along a path comprising first and second portions, with the rate of polishing over said second portion being smaller than over said first portion, so as to compensate at least in part for the over-polishing effect that occurs on the edge of said workpiece over the first portion of the path.

The region of the workpiece that is situated outside said circumference is a ring of width lying in the range 0.1% to 30%, and typically about 10%, of the diameter of said workpiece (or of its main dimension such as its longest diagonal if the workpiece is not circular).

In a first embodiment, the workpiece for polishing has at least one edge overhanging beyond the polishing element, such that said second portion of the path takes place outside said polishing element. More particularly, with a rotary machine, the polishing element may be circular in shape and the workpiece for polishing may overhang beyond its outside edge, and/or the polishing element may present an opening defined by an inside edge of circular shape and the workpiece for polishing may overhang beyond said inside edge. For a linear machine, the workpiece may overhang beyond one of the side edges of the polishing element, or both of them.

In a second embodiment, the polishing element presents an edge of irregular shape with protuberances and notches, and the workpiece for polishing overhangs beyond said edge, at least in correspondence with some of said notches, such that said second path portion takes place outside said polishing element and is of a length, for any given point, that varies in irregular manner from one revolution of said workpiece to another. As in the first embodiment, with a rotary machine, the edge may be an outside edge and/or an inside edge, and with a linear machine it may be one or both side edges.

In a third embodiment, the polishing element presents a section that is deformed in at least one region close to one of its edges so as to exert on the workpiece for polishing in correspondence with said region a pressure that is less than the pressure exerted by the remainder of the polishing element, such that said second path portion takes place in said deformed region of the polishing element. As in the first and second embodiments, with a rotary machine, the edge may be an inside edge and/or an outside edge, and with a linear machine it may be one or both side edges.

Advantageously, the method in question is of the dual-face type, i.e. polishing takes place simultaneously on both opposite faces of the workpiece for polishing by using two polishing elements.

The present invention also provides a polishing element for use in a method as defined above, and wherein the element presents at least one edge of irregular shape, with protuberances and notches.

The present invention also provides a polishing element for use in a method as defined above, and wherein, in the vicinity of one of its edges, the element includes at least one zone presenting a polishing action that is less than the action presented by the remainder of said polishing element.

More particularly, such a polishing element may have at least one edge that is irregular in shape, having protuberances and notches, said edge extending between an inner limit and an outer limit, such that the zone defined between said inner and outer limits presents a "mean" polishing action that is less than the action presented by the remainder of said polishing element.

Alternatively, such a polishing element may have a peripheral region that presents a section that is deformed in such a manner as to exert pressure on the workpiece for polishing that is less than the pressure exerted by the remainder of the polishing element.

BRIEF DESCRIPTION OF THE DRAWINGS

Other characteristics, details, and advantages of the invention appear on reading the following description made with reference to the accompanying drawings, given by way of example, and in which.

MORE DETAILED DESCRIPTION

Figure 1A:
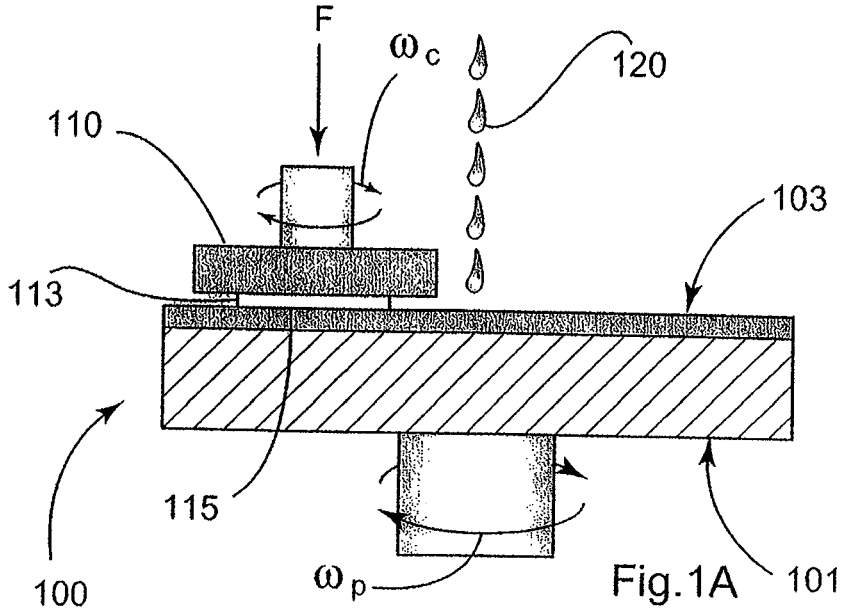
Fig.1A (PRIOR ART)
FIGS. 1A and 1B are respectively a side view and a plan view of a rotary CMP machine known in the prior art.

FIG. 1A is a side view of a rotary CMP machine 100 constituted by a turntable 101 rotating at an angular velocity $\omega_p$ and carrying on its top surface a polishing element 103. In a position that is eccentric relative to the turntable, there is a workpiece-carrier 110 rotating at an angular velocity $\omega_c$ that holds a workpiece 113 having a face 115 for polishing in such a manner as to force said face 115 against the polishing element 103 with pressure F, typically lying in the range 1 gram per square centimeter (g/cm$^2$) to 300 g/cm$^2$. A suspension of abrasive particles 120 drops onto an eccentric point of the polishing element 103 and is spread uniformly over its entire surface by the centrifugal effect.

Figure 1B:
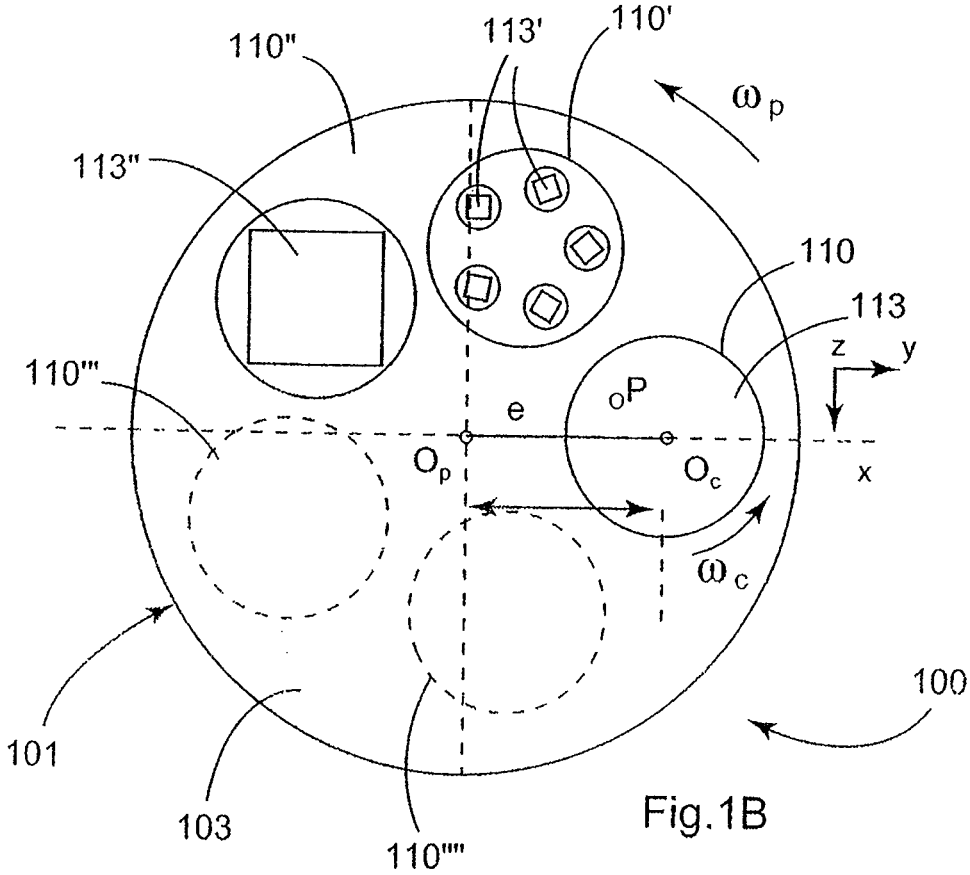
Fig.1B (PRIOR ART)

FIG. 1B is a plan view of the same CMP machine having a plurality of workpiece-carriers 110, 110'; 110", 110"", and 110"" placed above it. The workpiece-carrier 110 is holding a single circular workpiece, the workpiece-carrier 110' is holding a plurality of small workpieces 113' of different shapes, and the workpiece-carrier 110" is carrying a single workpiece 113" of rectangular shape.

It is considered that the rate of erosion $T_e$ as a point P on the surface for polishing is normally proportional to the pressure F and to the relative velocity V between the point P and the polishing element 103: this is Preston's equation which is written as follows:

$$T_e = K_P . V . F$$

where $K_P$ (Preston's coefficient) is an empirical parameter which, for a given surface for polishing, depends on the characteristics of the polishing element 103 and of the suspension of abrasive particles 120.

A simple cinematic calculation shows that if $\omega c = \omega_p$, then the velocity V is independent of the position of the point P and proportional solely to the product between $\omega_p$ and the distance e between the center of rotation $O_p$ of the turntable 101 and the center of rotation $O_c$ of the workpiece-carrier 110. In principle, these conditions should enable polishing to take place in optimum uniform manner, but technical conditions sometimes make it necessary to depart deliberately therefrom, in particular for the purpose of evening out possible non-uniformities in the polishing element. The simple cinematic model described above does not pretend to provide a complete description of the CMP process: in particular, it does not take account of phenomena associated with the polishing element being flattened and with a non-uniform distribution of the slurry, both of which contribute to the problem of over-polishing the edges of the workpiece, which problem is solved by the present invention.

Figure 2B:
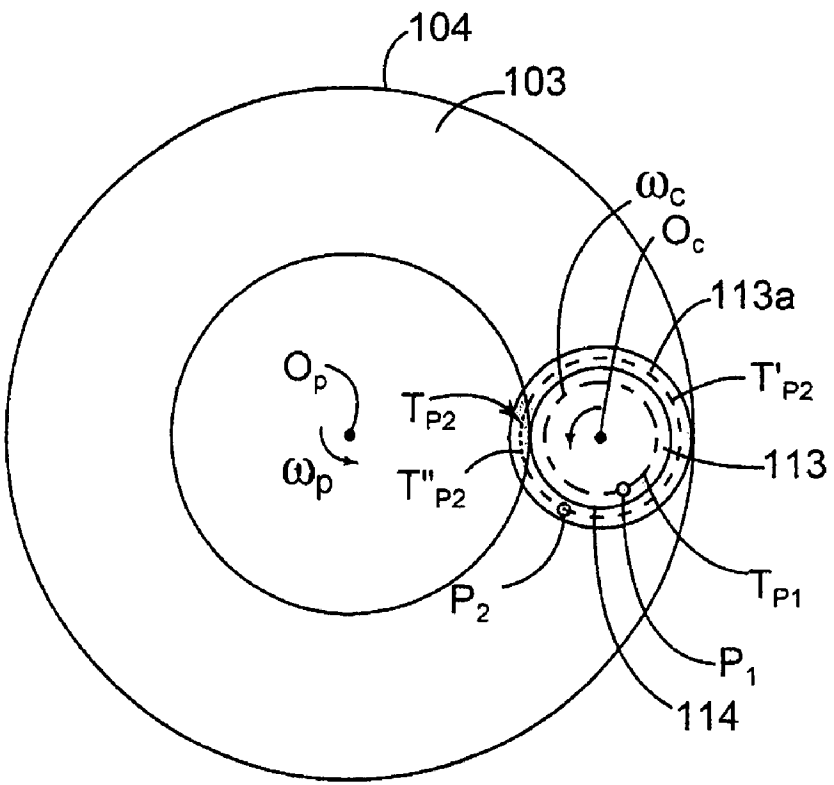
FIGS. 2A and 2B are plan views of a rotary CMP machine illustrating two variants of a first implementation of a method of the invention.
Figure 2A:
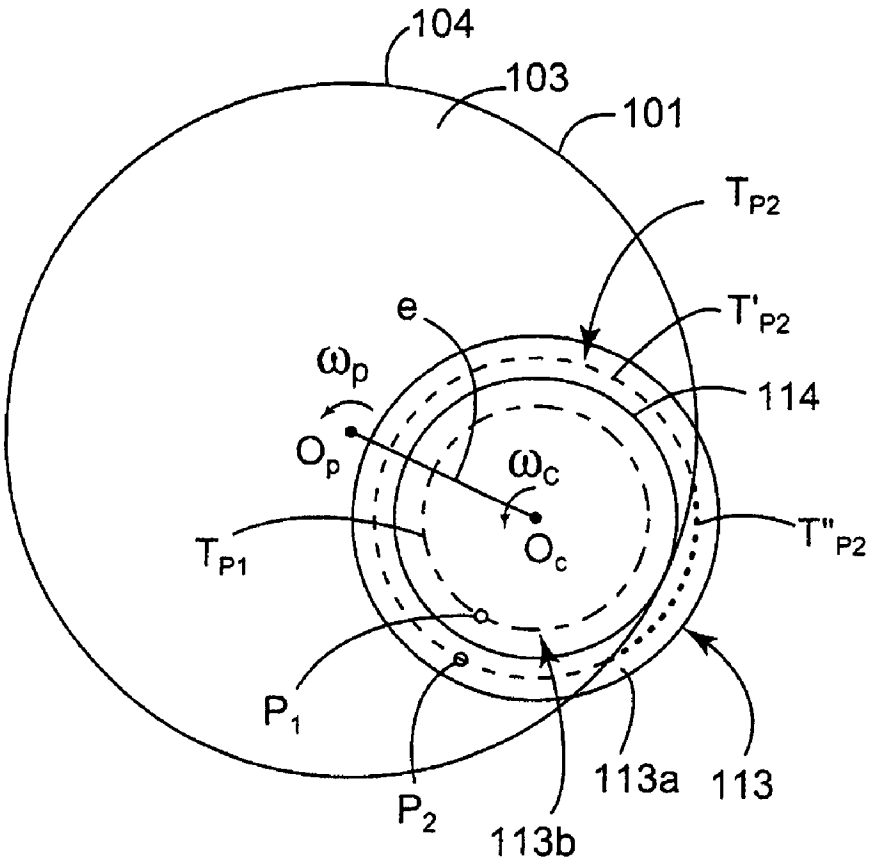
Figure 3:
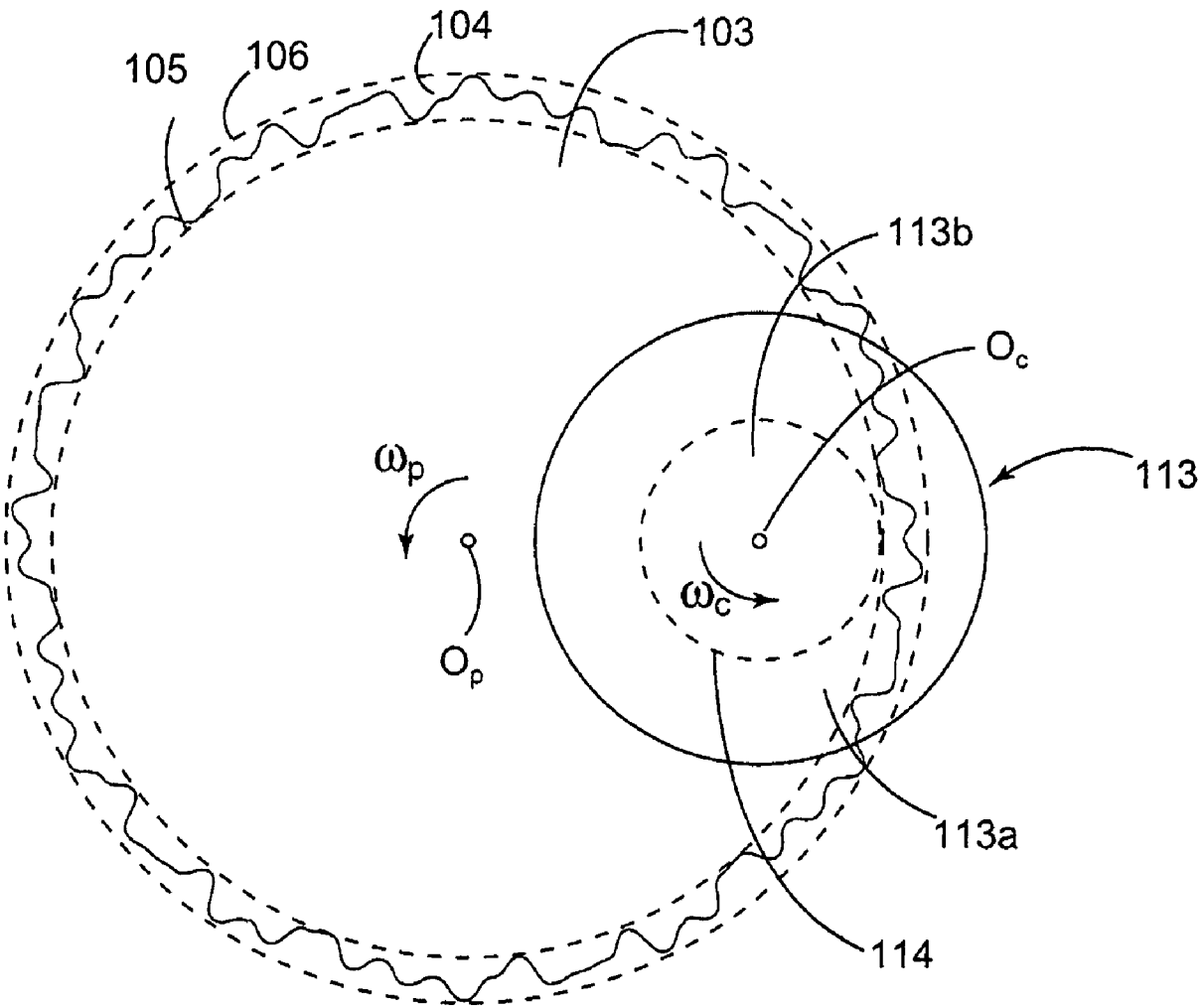
FIG. 3 is likewise a plan view showing a second embodiment.

FIG. 2A is a, plan view of a rotary CMP machine of the kind shown in FIGS. 1A and 1B, in which the polishing element 103 is circular in shape and of a diameter such that the workpiece 113 for polishing, likewise circular in shape and of center coinciding with the center of rotation $O_c$ of the workpiece-carrier, has its outer edge 104 projecting beyond the polishing element 103 by a fraction of its own diameter lying in the range 0.1% to 30%, and typically being about 10%. Alternatively, the center of the workpiece may be offset deliberately away from the center of rotation of the workpiece-carrier. In the figure, a construction line 114 marks the boundary between an inner zone 113*b* and an outer zone 113*a* in the form of a circular ring and constituted by points which are caused at some stage during the rotation of the workpiece 113 to go beyond the polishing element. In FIGS. 2A, 2B, and 3, it must be understood that the width of the zone 113*a* is greatly exaggerated for reasons of clarity.

A point P1 situated in the zone 113*b* follows a circular path $T_{P1}$ that lies entirely within the polishing element 103; if the operating configuration of the machine is such that $\omega_c = \omega_p$, then the rate of erosion corresponding to point P1, as determined by Preston's equation, is substantially constant over the entire path. The condition $\omega_c = \omega_p$ is mentioned by way of example only and it is not essential. Typically, $0.1 \leqq |\omega_c/\omega_p| \leqq 10$, and preferably $0.5 \leqq |\omega_c/\omega_p| \leqq 2$, with the angular velocities $\omega_c$ and $\omega_p$ generally lying in the range 1 revolution per minute (rpm) to 60 rpm, and possibly being opposite in sign.

In contrast, a point P2 situated in the zone 113*a* follows a circular path $T_{P2}$ made up of a first portion $T'_{P2}$ lying within the polishing element 103, over which the rate of erosion is greater than that at the point P1 because of said over-polishing effect, and a second portion $T''_{P2}$ outside the polishing element 103 in which the rate of erosion is zero. The closer the point P2 to the outside edge of the workpiece 113, the longer said second portion $T''_{P2}$ of its path.

The principle of the invention is to compensate the over-polishing to which the surface of the workpiece 113 is subjected in the vicinity of the edge of the workpiece while traveling along the internal first portion $T'_{P2}$ of its path by the absence of polishing that characterizes the second portion $T''_{P2}$ of the same path. Ideally, after one complete revolution of the workpiece 113, the amount of erosion that occurs at the point P1 should be equal to that which occurs at the point P2, regardless of the position of the point P2 within the zone 113*a*. In general, it is not possible to achieve this ideal in full, but by experimentation and/or with the help of a numerical model, working conditions can be found that come as close as possible thereto. Typically, it is difficult to modify the distance e between the center of rotation $O_p$ of the turntable 101 and the center of rotation $O_c$ of the workpiece-carrier, since that is a characteristic specific to the CMP machine being used. It is therefore preferable to vary the diameter of the polishing element so as to obtain an optimum value for the overhang of the workpiece 113.

In a variant, as shown in FIG. 2B, the polishing element 103 may be in the form of a circular ring, and the workpiece 113 may overhang its inside edge, or both its outside edge 104 and its inside edge (not shown).

In some circumstances, this first implementation of a method of the invention does not give satisfactory results because the transition between the zones 113*a* and 113*b* can lead to a step-shaped discontinuity appearing along the line 114.

A second implementation of the method of the invention is shown in FIG. 3 and serves to mitigate this drawback by using an outside edge 104 and/or an inside edge (not shown) of non-circular outline, preferably being irregular in shape with protuberances and notches. The edge 104 of the polishing element then lies between an inner circumference 105 and an outer circumference 106. The zone 113*a* is redefined in this implementation as being constituted by the points of the workpiece 113 which, during rotation of said workpiece, come at some stage to overhang beyond the inner circumference 105. As in the first implementation, the width of the zone 113*a* generally lies in the range 0.1% to 30% of the diameter or of the main dimension of the workpiece 113 and is typically about 10%. The length of the second portion $T''_{P2}$ of the path of a point P2 belonging to the zone 113*a* lies between a maximum value, which is that which corresponds to a polishing element having an outer edge coinciding with the inner circumference 105, and a minimum value which is that corresponding to a polishing element having an outer edge coinciding with the outer circumference 106, and which is zero for points that cannot overhang beyond said outer circumference 106. If the angular velocities $\omega_c$ and $\omega_p$ differ, even if only a little, this length varies irregularly from one revolution of the workpiece 113 to another. This leads to an averaging effect which prevents a step-shaped discontinuity appearing, as can happen when performing the first implementation of the method of the invention. The ratio between $\omega_c$ and $\omega_p$ generally lies in the range 0.1 to 10, and preferably in the range 0.5 to 2 in absolute value, but it is not equal to 1 in order to allow said averaging effect to take place.

Below it is assumed that the workpiece 113 overhangs the outer edge 104 of the polishing element 103, but as in the first embodiment, it is also possible to make use of an inside cutout.

Figure 4:
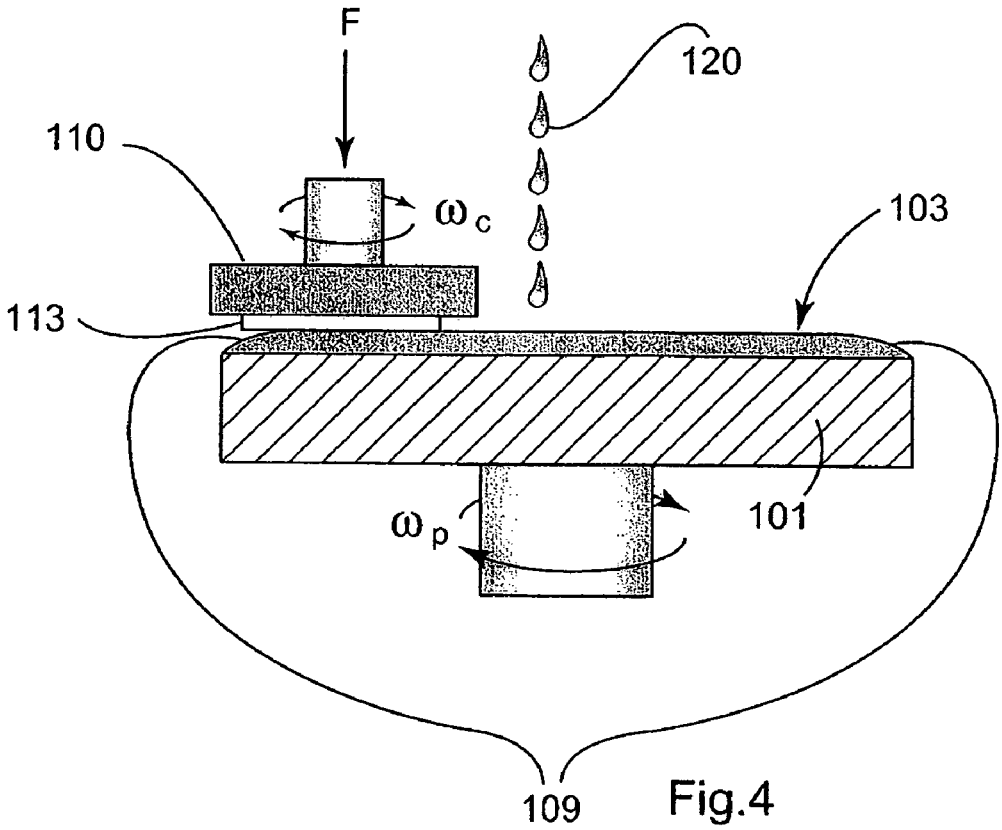
FIG. 4 is a side view of a rotary CMP machine illustrating a third embodiment.

In a third implementation, shown in FIG. 4, the peripheral portion 109 of the polishing element 103 is deformed in radial section so as to exert smaller pressure on the workpiece 113 than it does it in its central portion (where the deformation of the polishing element is greatly exaggerated in FIG. 4 for reasons of clarity). By way of example, this deformation may comprise thinning of the polishing element by selective wear (running in), or it may comprise deformation of the rigid turntable 101 as can be obtained by deforming its peripheral portion a little on going away from the workpiece 113. This thinning or deformation is applied to a peripheral zone of the polishing element 103 or to the turntable 101 over a width that generally lies in the range 0.1% to 30% of the diameter or the main dimension of the workpiece 113, and is typically about 10%. The amplitude of said thinning or deformation lies in the range a few micrometers to a few hundreds of micrometers, and preferably lies in the range a few micrometers to a few tens of micrometers.

The principle is substantially the same as in the first two implementations of the invention: over-polishing is compensated by the fact that points near to the edge of the workpiece 113 travel along a path having some fraction that coincides with a portion 109 of the polishing element 103 that produces a smaller amount of erosion. This implementation is more complex to put into practice, particularly in comparison with the first implementation, but the process can be optimized more finely.

By way of example, the optimization method can consist in starting with a non-deformed polishing element and in carrying out tests with ever increasing amounts of deformation.

As in the other implementations of the invention, the angular velocities $\omega_c$ and $\omega_p$ generally lie in the range 1 rpm to 60 rpm, and their ratio in absolute value generally lies in the range 0.1 to 10, and preferably in the range 0.5 to 2.

A portion of the workpiece may optionally overhang the edge 104 of the polishing element, as in the first implementation. It is also possible to combine the various implementations: the polishing element may be in the form of a circular ring as shown in FIG. 2B, it may have edges that are irregular, as shown in FIG. 3, and it may be deformed as in the third implementation close to its inner and outer edges.

Figure 5:
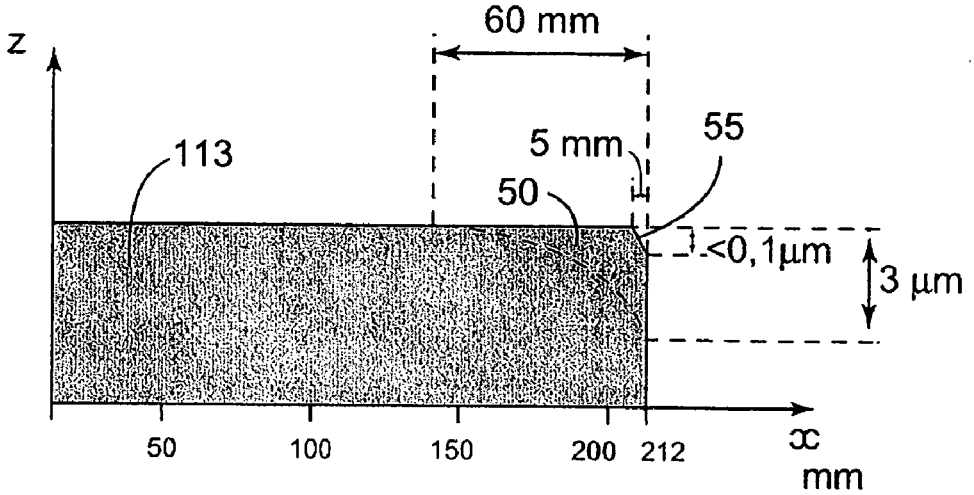
FIG. 5 serves to access the effect of over-polishing the edges as obtained with a CMP machine as known in the prior art and the extent to which this effect is reduced by implementing the invention.

FIG. 5 (not to scale) is a section view of the peripheral region of the workpiece 113 as polished by a method of the invention (continuous line) and as polished by a conventional CMP process (dashed lines). The section is along a diagonal of a square workpiece measuring 300 mm by 300 mm. When a conventional process is used, it can be seen that the over-polishing effect can lead to a decrease of up to 3 micrometers (μm) over a region 50 that is about 60 mm wide. In a method of the invention, in contrast, the corresponding reduction in the thickness of the workpiece at its edge is less than 0.1 μm, and it is restricted to a region 55 having a width of only about 5 mm approximately.

Three implementations of the invention are described above with reference to a rotary CMP machine for polishing a single face. Nevertheless, it should be understood that the invention applies equally to linear CMP machines, and to dual-face machines whether linear or rotary. As mentioned in the introduction, use of the invention is at its most advantageous when polishing two faces.

When polishing two faces of a plurality of workpieces 113' carried by a single workpiece-carrier 110' (see FIG. 1B), care must be taken to ensure that the workpieces can turn individually about their own centers, independently of the workpiece-carrier, so that the effect of compensating over-polishing takes place throughout.

Figure 6:
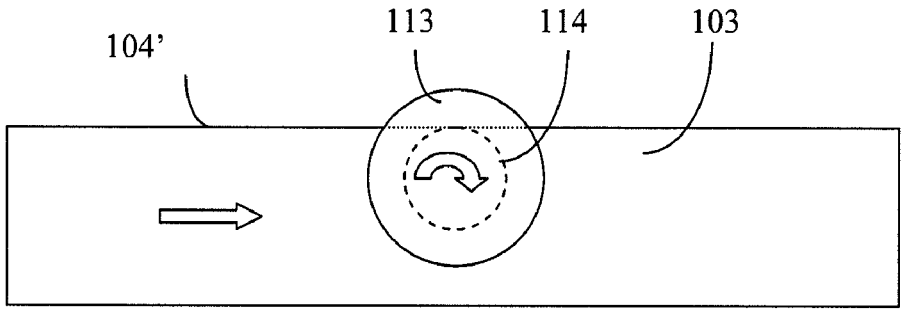
FIG. 6 is a plan view illustrating a CMP machine showing a fourth embodiment of the invention.

FIG. 6 shows a fourth embodiment of the invention, using a linear CMP machine, wherein a polishing element 103 is driven in translation while a workpiece 113 is set into rotation and has a surface pressed against said polishing element 103. The workpiece to be polished 113 overhangs a side edge 104' of the polishing element 103 in such a manner that points of said surface of the workpiece 113 lying outside a circumference 114 of given radius of center coinciding with the center of rotation of the workpiece travel, during rotation of said workpiece, along a path comprising first and second portions, said second portion of the path taking place away from said polishing element.

What is claimed is:

1. A method of polishing a surface comprising the step of setting into rotation at least one workpiece having at least one planar surface for polishing while pressing said planar surface against a polishing element that is driven with rotary or linear motion, wherein, throughout the duration of the polishing process, points of said planar surface of the workpiece that are situated outside a circumference of given radius of center coinciding with the center of rotation of the workpiece travel, during rotation of said workpiece, along a path comprising first and second portions, with the rate of polishing over said second portion being smaller than over said first portion, so as to compensate at least in part for the over-polishing effect that occurs on the edge of said workpiece over the first portion of the path, in which the region of the workpiece situated outside said circumference is of a width lying in the range 0.1% to 30% of the diameter or the main dimension of said workpiece.

2. A method according to claim 1, in which the ratio between the angular velocity of the workpiece and the angular velocity of the polishing element lies in the range 0.1 to 10 in absolute value.

3. A method according to claim 1, in which the ratio between the angular velocity of the workpiece and the angular velocity of the polishing element lies in the range 0.5 to 2 in absolute value.

4. A method according to claim 1, in which the workpiece for polishing overhangs beyond at least one of the edges of the polishing element in such a manner that said second portion of the path takes place away from said polishing element.

5. A method according to claim 4, in which the polishing element is circular in shape and the workpiece for polishing overhangs its outer edge.

6. A method according to claim 4, in which the polishing element presents an opening defined by an inner edge of circular shape, and the workpiece for polishing overhangs said inner edge.

7. A method according to claim 1, in which the polishing element presents at least one edge of irregular shape having protuberances and notches, and the workpiece for polishing overhangs said edge, at least in register with some of said notches, and in which the polishing element is rotated at an angular velocity that is different from the angular velocity of the workpiece, such that said second portion of the path takes place away from said polishing element over a length which, for any given point varies in irregular manner from one revolution of said workpiece to another.

8. A method according to claim 1, in which the polishing element presents at least one edge of irregular shape, having protuberances and notches, and the workpiece for polishing overhangs said edge, at least in register with some of said notches, and in which the polishing element is driven in translation, such that said second portion of the path lies away from said polishing element and is of a length which, for any given point, varies in irregular manner from one revolution of said workpiece to another.

9. A method according to claim 1, in which the polishing element presents a section that is deformed in at least one region close to one of its edges so as to exert on said workpiece for polishing, in register with said region, pressure that is less than the pressure exerted over the remainder of the polishing element, such that said second portion of the path takes place in said deformed region of the polishing element.

10. A method according to claim 1, in which polishing takes place simultaneously on two opposite faces of the workpiece to be polished, using two polishing elements.

11. A method according to claim 1, in which said relative width of the region of the workpiece situated outside said circumference is about 10%.

* * * * *